US010060664B2

(12) United States Patent
Celik et al.

(10) Patent No.: US 10,060,664 B2
(45) Date of Patent: Aug. 28, 2018

(54) ICE MAKING APPARATUS WITH IMPROVED WATER REPLENISHMENT FACILITY AND REFRIGERATOR HAVING THE SAME

(71) Applicant: ARCELIK ANONIM SIRKETI, Istanbul (TR)

(72) Inventors: Kadir Ridvan Celik, Istanbul (TR); Mehmet Ercan Kaymak, Istanbul (TR); Faik Emre Ozyuksel, Istanbul (TR); Umud Yazgan, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 154 days.

(21) Appl. No.: 15/033,891

(22) PCT Filed: Nov. 1, 2013

(86) PCT No.: PCT/EP2013/072858

§ 371 (c)(1),
(2) Date: May 2, 2016

(87) PCT Pub. No.: WO2015/062667

PCT Pub. Date: May 7, 2015

(65) Prior Publication Data

US 2016/0273820 A1 Sep. 22, 2016

(51) Int. Cl.
*F25C 5/18* (2018.01)
*F25C 1/22* (2018.01)
(Continued)

(52) U.S. Cl.
CPC ..... *F25C 1/225* (2013.01); *F25C 1/25* (2018.01); *F25D 11/02* (2013.01); *F25C 2400/14* (2013.01); *F25C 2500/06* (2013.01)

(58) Field of Classification Search
CPC .. F25C 1/225; F25C 2500/06; F25C 2400/14; F25C 1/25; F25D 11/02
See application file for complete search history.

(56) References Cited

U.S. PATENT DOCUMENTS 5,870,944 A * 2/1999 Vander Zalm ..... A23L 2/54 261/DIG. 7
8,316,661 B2 11/2012 Choi
(Continued)

FOREIGN PATENT DOCUMENTS

CN 1189600 A 8/1998
CN 1853076 A 10/2006
(Continued)

OTHER PUBLICATIONS

International search report for PCT/EP2013/072858 and reference cited therein.
(Continued)

*Primary Examiner* — Ana Vazquez
(74) *Attorney, Agent, or Firm* — Kilpatrick Townsend & Stockton LLP

(57) ABSTRACT

The present invention relates to an ice making apparatus suitable for use in a refrigerator including a freezer compartment. The ice making apparatus includes a casing which includes an ice tray for forming ice, wherein the ice tray has one or more than one pocket for filling with water. The ice making apparatus further includes a portable refillable cartridge which has an opening for dispensing water into the ice tray and a port for releasably mounting the cartridge.

15 Claims, 11 Drawing Sheets

Figure 1:
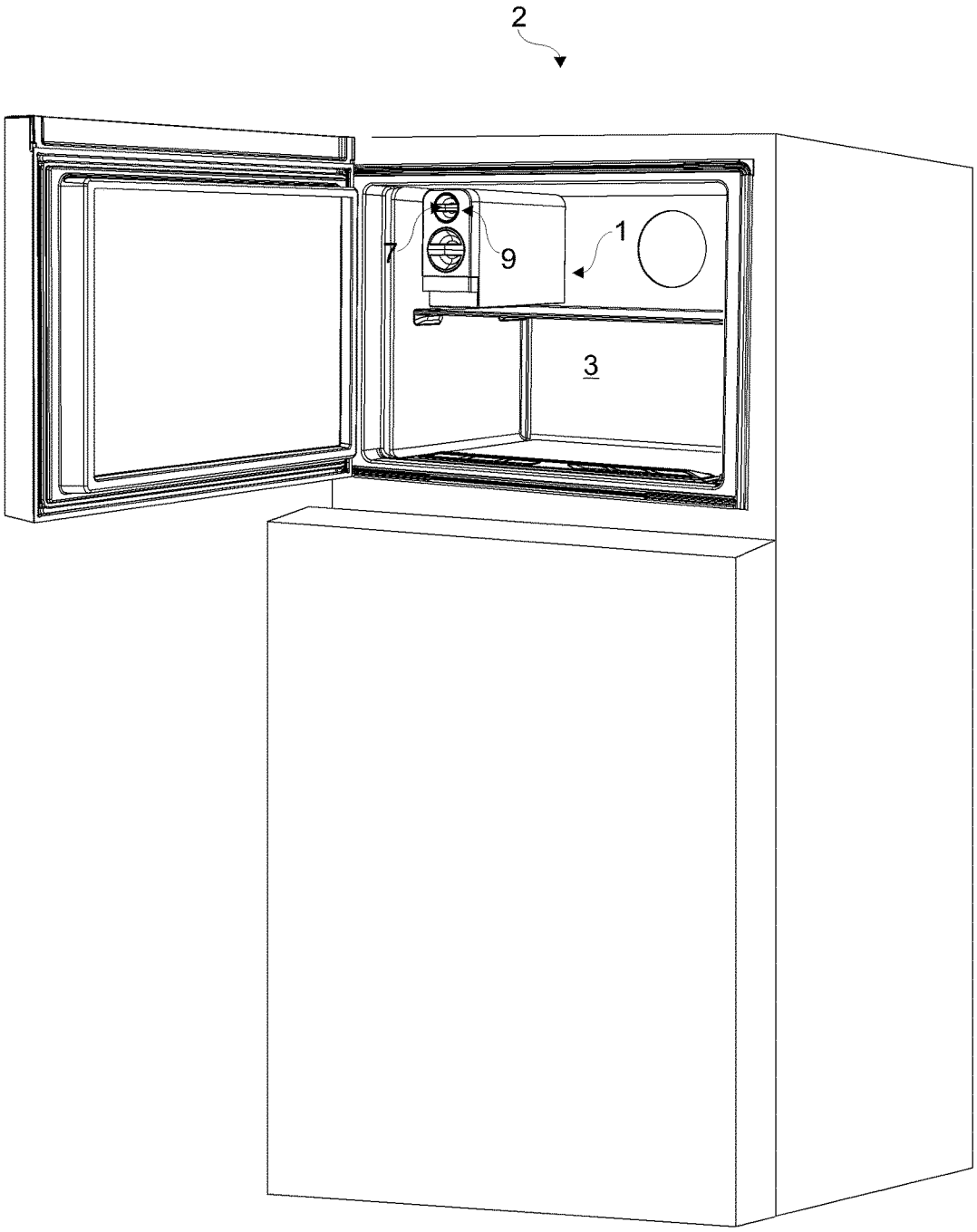

(51) Int. Cl.
*F25D 11/02* (2006.01)
*F25C 1/25* (2018.01)

(56) References Cited

U.S. PATENT DOCUMENTS

| | | | | |
|---|---|---|---|---|
| 2007/0012061 | A1* | 1/2007 | Ribeiro | F25C 1/22 62/344 |
| 2009/0178431 | A1 | 7/2009 | Cho | |
| 2010/0163707 | A1* | 7/2010 | Kim | F25C 1/04 249/120 |
| 2013/0305766 | A1* | 11/2013 | Seo | F25C 1/225 62/340 |

FOREIGN PATENT DOCUMENTS

| | | | | |
|---|---|---|---|---|
| CN | 101074812 | A | 11/2007 | |
| CN | 102538359 | A | 7/2012 | |
| JP | H07332821 | A | 12/1995 | |
| JP | H10220944 | A | 8/1998 | |
| JP | 2002277122 | A | 9/2002 | |
| WO | 2005010447 | A1 | 2/2005 | |
| WO | WO 2005010447 | A1 * | 2/2005 | F25C 1/225 |

OTHER PUBLICATIONS

Written opinion of international searching authority for PCT/EP2013/072858 and reference cited therein.

* cited by examiner

ICE MAKING APPARATUS WITH IMPROVED WATER REPLENISHMENT FACILITY AND REFRIGERATOR HAVING THE SAME

RELATED APPLICATIONS

This application is a U.S. National Phase of International Application No. PCT/EP2013/072858, filed Nov. 1, 2013, the entire disclosure of which is incorporated by reference herein.

The present invention relates to an ice making apparatus for use in a refrigeration appliance such as a domestic refrigerator which has a freezer compartment. The present invention particularly relates to an ice making apparatus which has a water replenishment facility.

It is customary to provide a domestic refrigerator with an ice tray for making ice. The user fills the ice tray, and subsequently places the ice tray in a freezer compartment of the refrigerator. When fresh ice is formed in the ice tray, the user takes the ice tray out of the freezer compartment, and subsequently twists the ice tray to release the ice cubes from the pockets thereof. The released ice cubes are typically collected in a portable container for service. This technique is very laborious and time consuming for a user.

Ice making apparatuses which are installable into domestic refrigerators are also commonly known. Such an ice making apparatus generally facilitates the aforementioned ice making process and the ice releasing process. A typical ice making apparatus includes one or more than one an ice tray and a container for collecting the ice which is released from the ice tray. The container is typically arranged below the ice tray. The user must generally only turn the ice tray upside-down to manually release the ice from the ice tray into the container, and subsequently replenish the ice tray with fresh water.

CN102538359 (A) discloses a refrigerator which has an ice making device. The ice making device includes: an ice tray for making ice; and an ice drawer for storing the released ice. The ice tray has a knob for rotating the ice tray to release the ice formed in the ice tray into the ice drawer. The ice making device has a casing which allows installation onto a door of the refrigerator.

In the above-mentioned ice making device, the user has to manually replenish the ice tray with water when the ice is exhausted. The user typically fills the ice tray by pouring water from a top of the ice making device. The user roughly estimates the amount of water to be filled during the replenishment. Consequently, it is very likely that the user replenishes either an insufficient amount of water or an excess amount of water into the ice tray. Thus, in both cases the ice making processing degrades.

In a case where the user does not have sufficient space for directly replenishing an ice making device, the user may alternatively demount the ice tray, refill it with water at a remote place, such as a sink, and remount the ice tray again into the ice making device. However also in this case, it is very likely that the user spills some amount of the replenished water, prior to remounting the ice tray into the ice making device. Thus, the ice making processing degrades.

An objective of the present invention is to provide an ice making apparatus suitable for use in a refrigerator which overcomes the aforementioned problems of the prior art and which has an improved usability.

This objective has been achieved by the ice making apparatus and the refrigerator according to the present invention.

The ice making apparatus according to the present invention has a portable refillable cartridge which has an opening for dispensing water into the ice tray; and a port for releasably mounting the cartridge. The port is arranged above the ice tray. In addition, the port has a guide for rotatably supporting the cartridge between a released position where the opening of the cartridge is located at an upper level and a mounted position where the opening of the cartridge is located at a lower level. Thereby, the customer can easily replenish the ice making apparatus with the correct amount of water without spillage. When the ice is exhausted, the customer removes the cartridge from the port, refills the cartridge with fresh water, e.g., at a remote place such as a sink, and subsequently remounts it to the port. To dispense water to the ice tray, the customer rotates the cartridge such that the opening is moved from the upper level to the lower level. As the cartridge is rotated, the water in the cartridge smoothly flows into the ice tray. Thereby, a water replenishment process of the ice making apparatus is improved.

In an embodiment, the ice making apparatus is a transportable free-standing apparatus which can be freely placed on a shelf or on a base of the freezer compartment.

In an alternative embodiment, the ice making apparatus is slidably mountable from its top to a ceiling of the freezer compartment.

In another embodiment, the ice tray is rotatably arranged into the ice making apparatus. In this embodiment, the ice tray is resiliently biased by means of a resilient member towards an upright position. In this embodiment, the ice tray has a knob for manually rotating it up-side down to release the ice formed therein into an ice drawer which is arranged below the ice tray.

In another embodiment, the ice tray is rotatably arranged into a housing which is detachably mountable into a casing of the ice making apparatus. The resilient member is interposed between the ice tray and the housing. The ice tray is also provided with a detachable knob. By virtue of the housing, the rotatable ice tray and its biasing mechanism can be easily assembled with the casing.

In another embodiment, the cartridge is a cylindrical shaped container. The cartridge includes a knob for manually rotating of the container. The knob is detachably mountable to a bottom the container. The cartridge further includes an openable/closable lid for refilling the container. The lid is mountable to a top of the container. The lid has also an opening for dispensing the water into the ice tray.

In another embodiment, the port is configured by a horizontally aligned cylindrical shaped slot for inserting the cartridge into the casing. The inner wall of the slot rotatably supports the cartridge.

In another embodiment, the inner wall of the slot has also a curved channel by which the cartridge is advanced in a horizontal direction along a length direction of the ice tray as it is manually rotated by a customer. Thereby, the cartridge is pushed into or out of the casing as it is rotated by the customer.

In another embodiment, the opening of the cartridge has a cross section which extends along the peripheral direction to prevent a vacuum effect when discharging the water into the ice tray.

In another embodiment, the cartridge has various markings which for example respectively indicate a level of water to be filled into the cartridges, and a relative rotational position of the opening. The markings facilitate handling of the cartridge.

The rotatable cartridge of the ice making apparatus of the present invention, enables a simple and a reliable way of refilling the ice tray, in particular with the correct amount of fresh water. The ice making apparatus of the present invention can be utilized as a ceiling-mount apparatus or a free-standing apparatus. Thus, the ice making apparatus of the present invention, can be easily taken out of the refrigerator for cleaning and maintenance purposes. Thereby, a usability of the ice making apparatus is improved.

Additional advantages of the ice making apparatus according to the present invention and the refrigerator according to the present invention will become apparent with the detailed description of the embodiments with reference to the accompanying drawings in which:

FIG. 1—is a schematic perspective view of a refrigerator which has an ice making apparatus in its freezer compartment according to an embodiment of the present invention.

Figure 2:
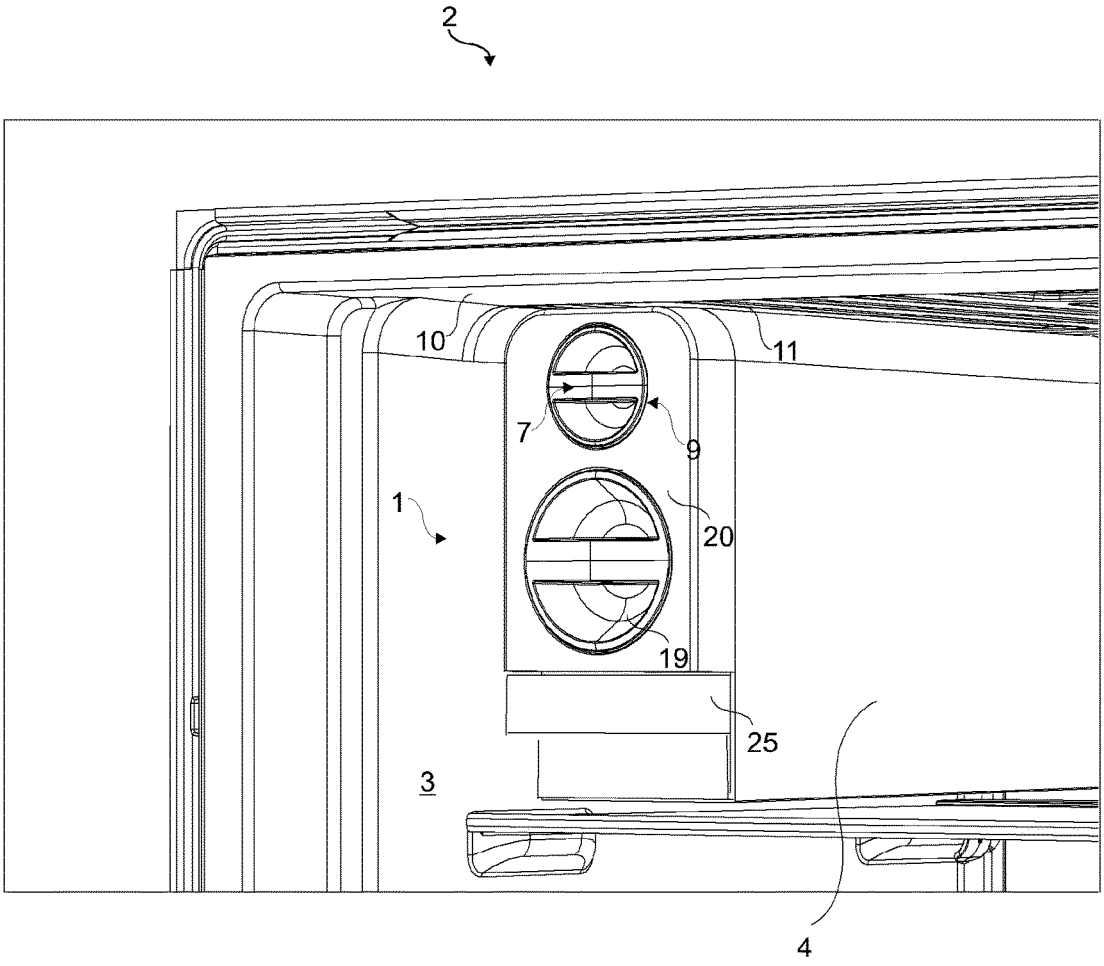

FIG. 2—is an enlarged schematic perspective partial view of the refrigerator as shown in FIG. 1.

Figure 3:
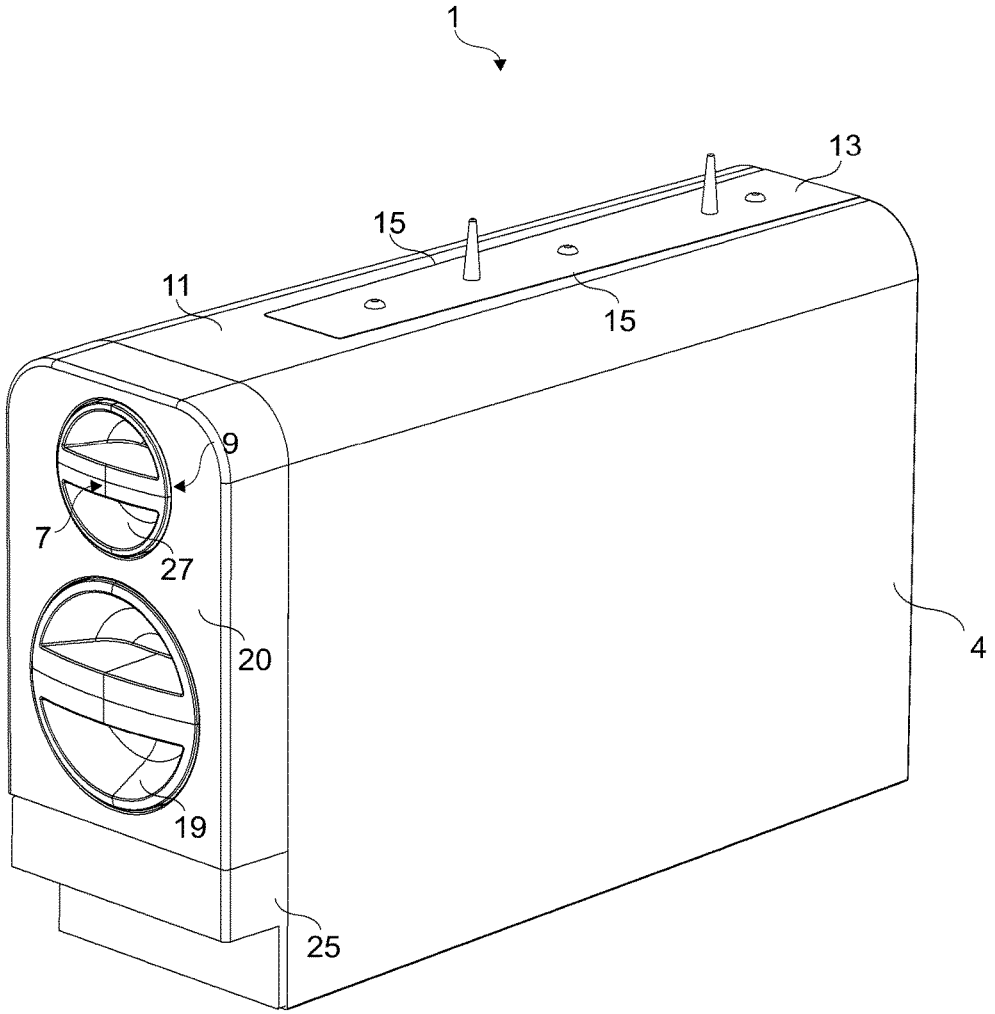

FIG. 3—is a schematic perspective front view of the ice making apparatus shown in FIG. 1, prior to mounting into the freezer compartment of the refrigerator.

Figure 4:
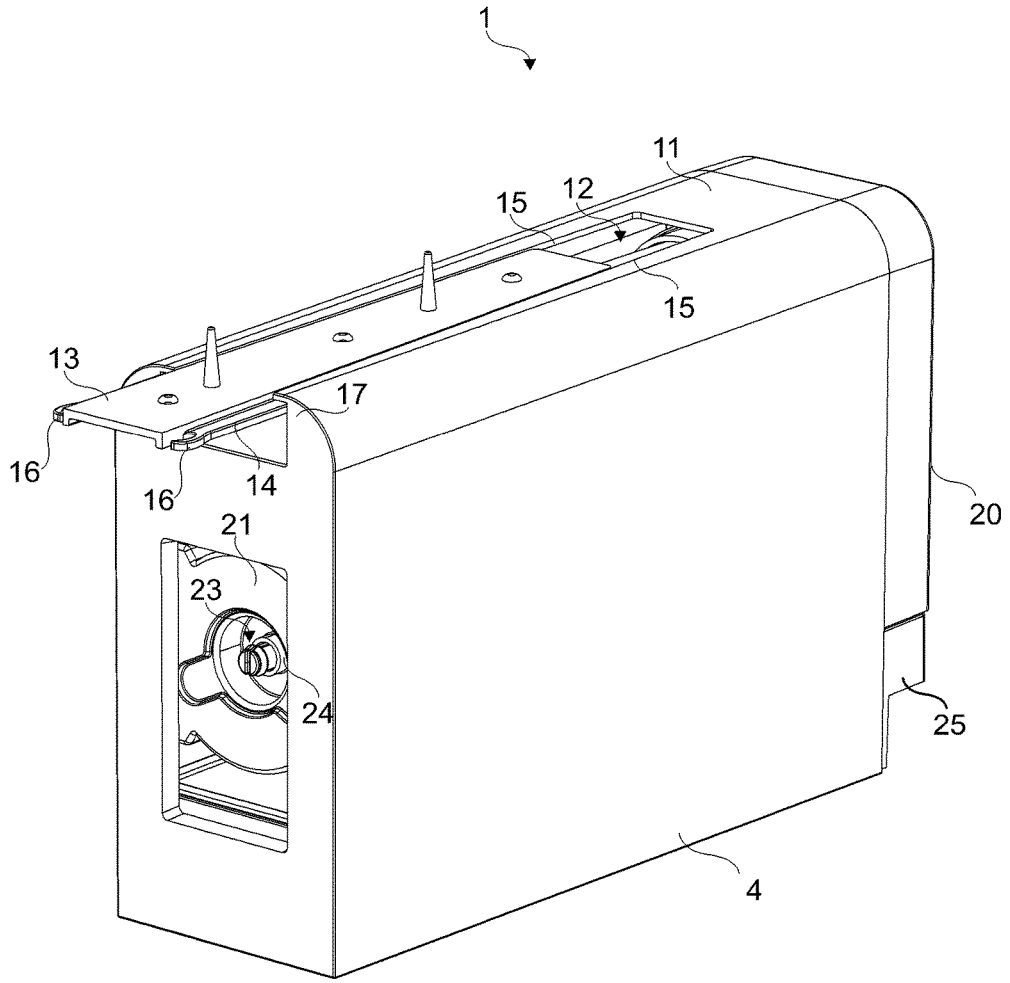

FIG. 4—is schematic perspective rear view of the ice making apparatus shown in FIG. 1, prior to mounting into the freezer compartment of the refrigerator.

Figure 5:
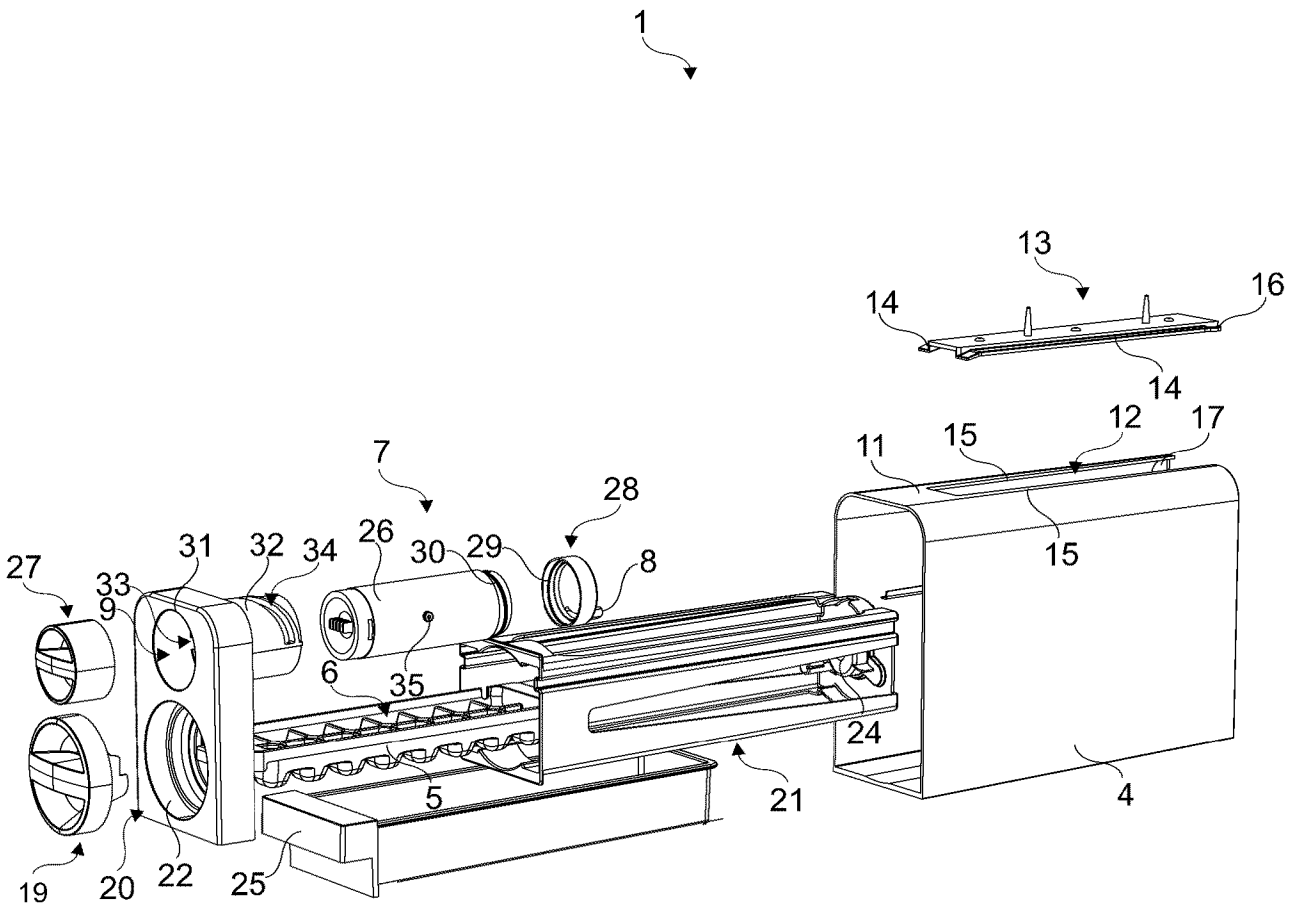

FIG. 5—is a schematic perspective exploded view of the ice making apparatus according to an embodiment of the present invention.

Figure 6:
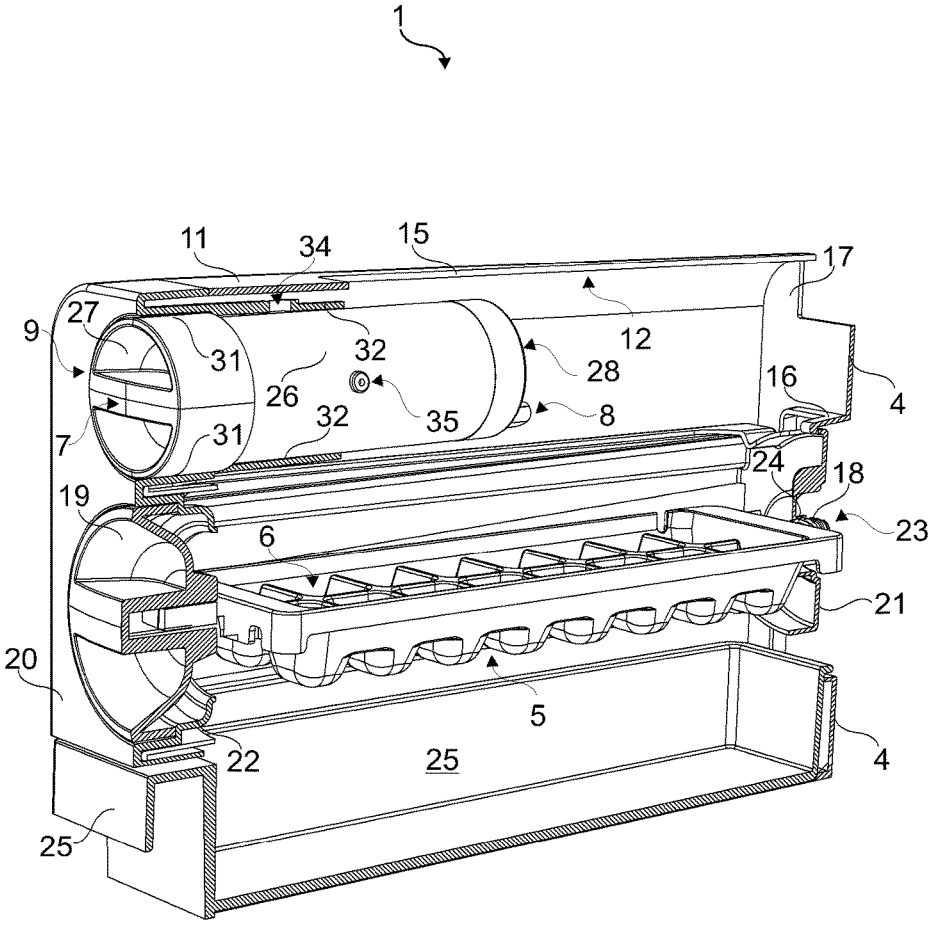

FIG. 6—is a schematic perspective cross sectional front view of the ice making apparatus according to an embodiment of the present invention.

Figure 7:
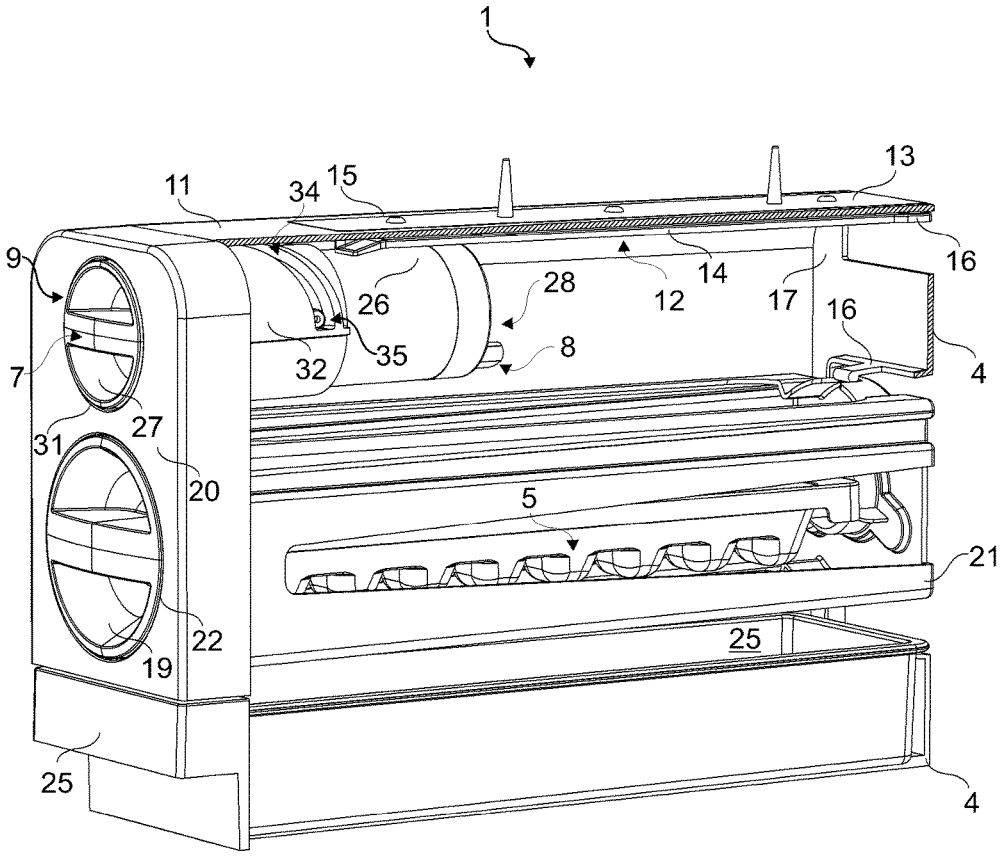

FIG. 7—is another schematic perspective cross sectional front view of the ice making apparatus according to an embodiment of the present invention.

Figure 8:
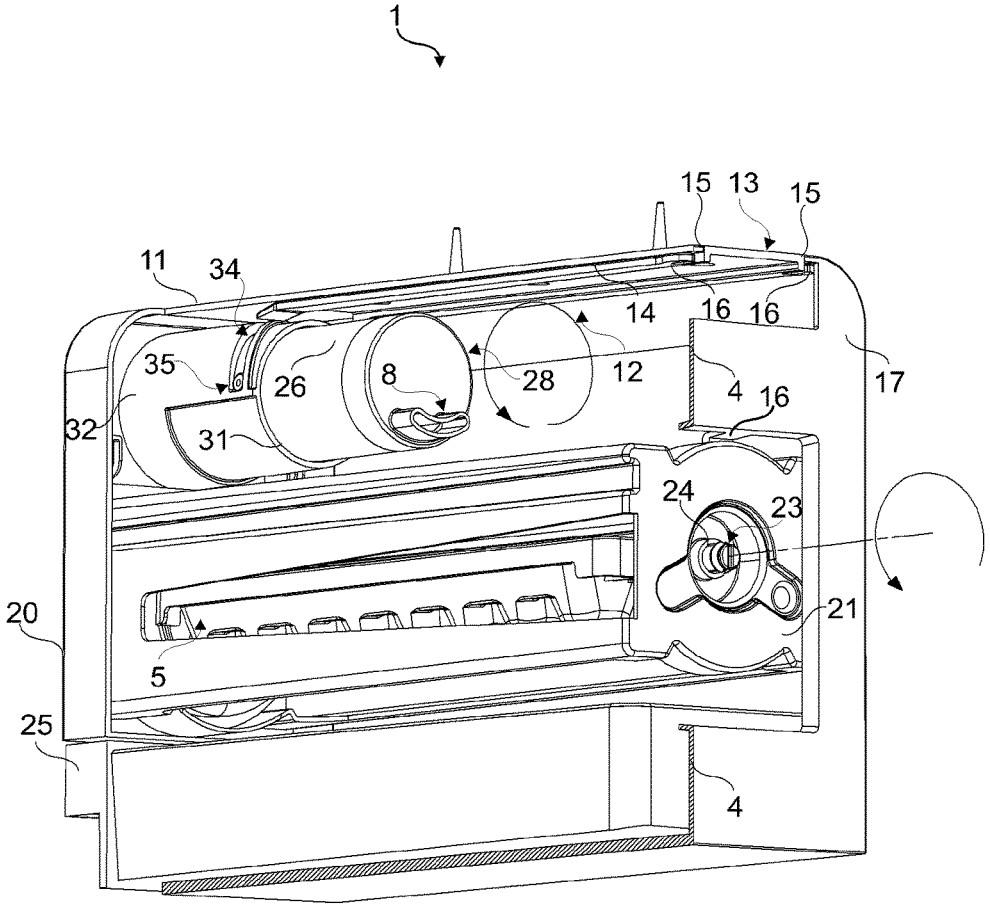

FIG. 8—is a schematic perspective cross sectional rear view of the ice making apparatus according to an embodiment of the present invention.

Figure 9:
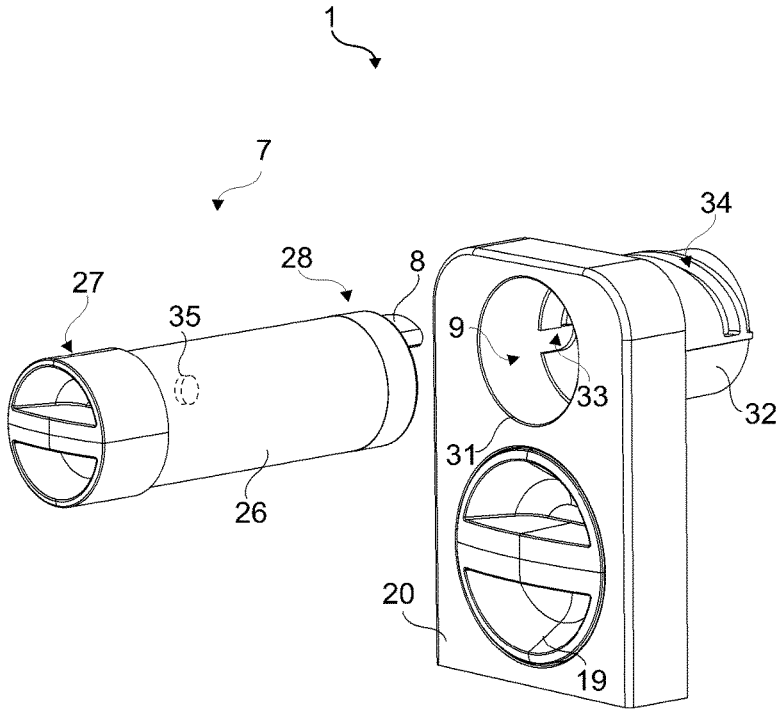

FIG. 9—is schematic perspective partial view of the ice making apparatus according to an embodiment of the present invention, prior to mounting a portable refillable cartridge to a port thereof.

Figure 10:
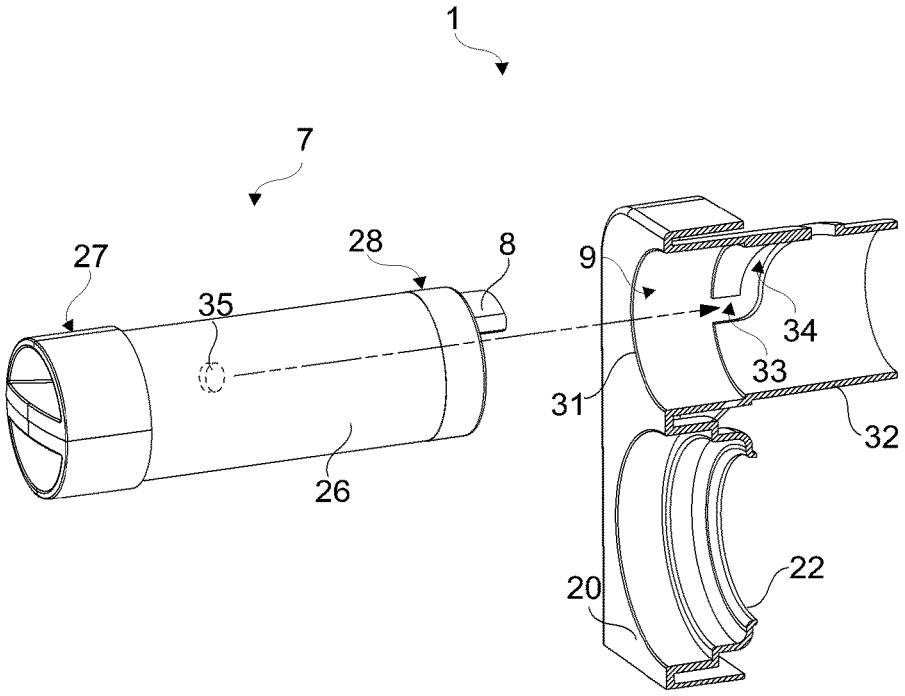

FIG. 10—is schematic perspective cross sectional partial view of the ice making apparatus according to an embodiment of the present invention, prior to mounting the portable refillable cartridge to the port thereof.

Figure 11:
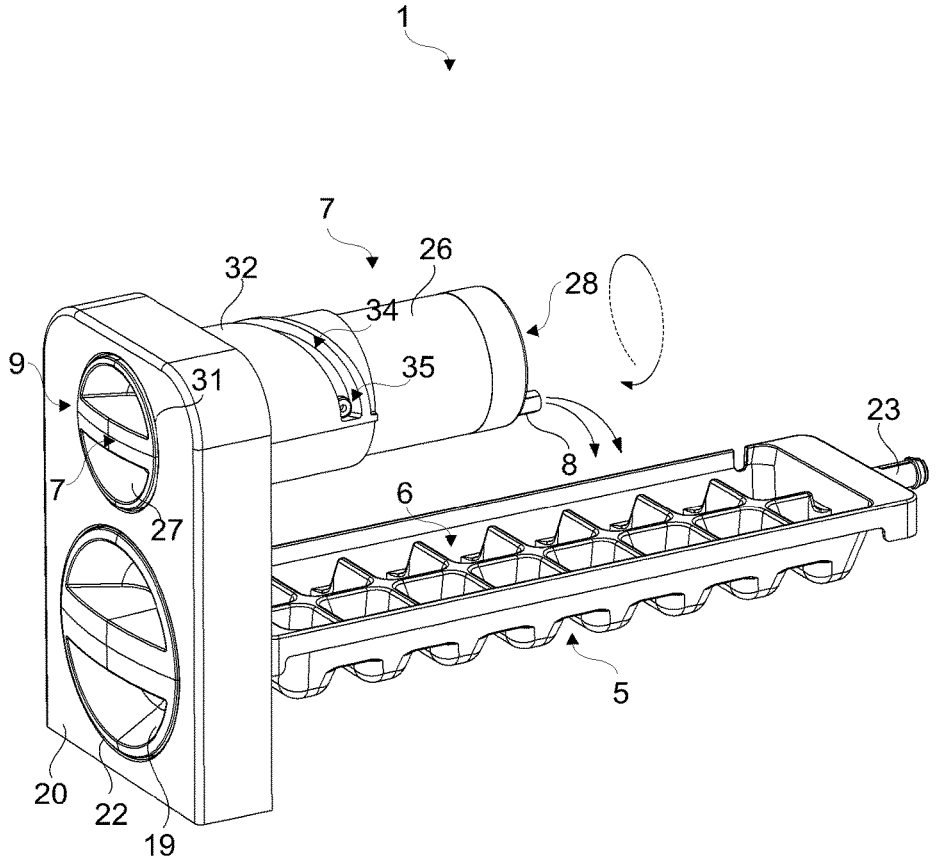

FIG. 11—is schematic perspective partial view of the ice making apparatus according to an embodiment of the present invention, after having mounted the portable refillable cartridge to the port while water is being dispensed to the ice tray.

The reference signs appearing on the drawings relate to the following technical features.

1. Ice making apparatus
2. Refrigerator
3. Freezer compartment
4. Casing
5. Ice tray
6. Pocket
7. Cartridge
8. Opening
9. Port
10. Ceiling
11. Upper wall
12. First slot
13. Support member
14. Support rail
15. Edge
16. Arresting claw
17. Rear wall
18. Resilient member
19. First knob
20. Front wall
21. Housing
22. First bearing
23. Pivot
24. Second bearing
25. Ice drawer
26. Cylindrical outer wall
27. Second knob
28. Lid
29. First threaded portion
30. Second threaded portion
31. Second slot
32. Cylindrical inner wall
33. First channel
34. Second channel
35. Pin The ice making apparatus (1) is suitable for use in a refrigerator (2) comprising a freezer compartment (3) (FIG. 1). The ice making apparatus (1) comprises a casing (4) (FIGS. 2 to 8). The casing (4) includes an ice tray (5) for forming ice therein (FIGS. 5 to 8; FIG. 11). The ice tray (5) has one or more than one pocket (6) for filling with fresh water (FIGS. 5 to 8; FIG. 11).

The ice making apparatus (1) according to the present invention comprises:

a portable refillable cartridge (7) (FIGS. 1 to 3). The cartridge has an opening (8) for dispensing water into the ice tray (5) (FIGS. 5 to 11). The ice making apparatus (1) according to the present invention further comprises: a port (9) for releasably mounting the cartridge (7) (FIGS. 1 to 3; FIGS. 5 to 7; FIGS. 9 to 11). The port (9) is arranged above the ice tray (5) (FIGS. 5 to 8; FIG. 11). In addition, the port (9) has a guide for rotatably supporting the cartridge (7) between a released position where the opening (8) of the cartridge (7) is located at an upper level and a mounted position where the opening (8) of the cartridge (7) is located at a lower level (FIGS. 9 to 11).

In an embodiment, the ice making apparatus (1) is mountable from its upper wall (11) to a ceiling (10) of the freezer compartment (3) (FIGS. 1 and 2). In this embodiment, the ice making apparatus (1) has a first engagement portion and a second engagement. The first engagement portion is mountable onto a ceiling (10) of the freezer compartment (3) (FIGS. 1 to 3). The second engagement portion is suitable for slidably mounting an upper wall (11) of the casing (4) to the first engagement portion (FIG. 4).

In another embodiment, the second engagement portion is configured by a rectangular shaped first slot (12) (FIGS. 4 to 8). The first slot (12) is formed into an upper wall (11) of the casing (4) (FIGS. 4 to 8). In this embodiment, the first engagement portion is configured by a support member (13) (FIGS. 3 to 8). The support member (13) has a rectangular shaped support rail (14) which slidably engages with an edge (15) of the first slot (12) (FIGS. 3 to 8). The support member (13) also has one or more than one arresting claw (16) which releasably engages with a rear wall (17) of the casing (4) (FIGS. 4 to 5; FIGS. 7 to 8).

In an alternative embodiment (not shown), the ice making apparatus (1) is not detachably mountable to the freezer compartment (3). In this embodiment, the ice making apparatus (1) is freely installable on a shelf or on a base of the freezer compartment (3).

In another embodiment, the ice tray (5) is rotatably arranged between a first position where the pockets (6) face upwards and a second position where the pockets (6) face downwards (FIGS. 5 to 8; FIG. 11). In this embodiment, the ice tray (5) is resiliently biased towards a first position by means of a resilient member (18) (FIG. 6). In this embodiment, the ice tray (5) has a first knob (19) for manually rotating the same (FIGS. 5 to 7; FIG. 11)

In another embodiment, the ice making apparatus (1) has a cover which configures a front wall (20) of the casing (4) (FIGS. 2 to 11). In this embodiment, the ice making apparatus (1) has a housing (21) which accommodates the ice tray (5) (FIGS. 4 to 8)

The housing (21) is detachably mounted into the casing (4) (FIGS. 4 to 8). In this embodiment, the resilient member (18) is interposed between a rear end of the ice tray (5) and a rear end of the housing (21) (FIG. 6). In this embodiment, the first knob (19) is detachably fixed to a front end of the ice tray (5), and rotatably arranged in a first bearing (22) which is formed into the front wall (20) (FIGS. 6 to 7). In this embodiment, the rear end of the ice tray (5) has a pivot (23) which is supported by a second bearing (24) which is formed in the rear end of the housing (21) (FIG. 6). By virtue of the housing (21), the ice tray (5) can be easily mounted into the casing (4).

In another embodiment, an inner side of the cover has one or more than one arresting claw (not shown) for releasably engaging with a front end of the housing (21). In this embodiment, a rear wall (17) of the casing (4) has also one or more than one arresting claw (16) for releasably engaging with a rear end of the housing (21) (FIGS. 6 to 8).

In another embodiment, the ice making apparatus (1) has an ice drawer (25) for storing the ice which is removed from the ice tray (5) (FIGS. 2 to 8). The ice drawer (25) is slidably arranged into a bottom of the casing (4) and below the ice tray (5) (FIGS. 2 to 8).

In another embodiment, the cartridge (7) includes: a cylindrical outer wall (26), a first end wall and a second end wall (FIGS. 5 to 11). The first end wall and the second end wall oppose each other. In this embodiment, the cartridge (7) further includes: a second knob (27) for manually rotating of the cartridge (7) (FIGS. 5 to 7; FIGS. 9 to 11). The second knob (27) is detachably mountable on the first end wall of the cartridge (7) (FIGS. 5 to 7; FIGS. 9 to 11). In this embodiment, the cartridge (7) further includes a lid (28) for refilling a space enclosed by the cylindrical outer wall (26), the first end wall and the second end wall (FIGS. 5 to 11). The second end wall of the cartridge (7) is configured by the lid (28). In this embodiment, the opening (8) is formed on the lid (28), at a position which is offset by a predetermined distance from an axis of rotation of the cylindrical outer wall (26) (FIGS. 5 to 11).

In another embodiment, the lid (28) has a first threaded portion (29) (FIG. 5). In this embodiment, the cylindrical outer wall (26) has a second threaded portion (30) (FIG. 5). The first threaded portion (29) and the second threaded portions (30) match each other (FIGS. 6 to 11).

In another embodiment, the port (9) is configured by a horizontal second slot (31) for inserting the cartridge (7) into the casing (4) (FIGS. 5 to 11). The second slot (31) has a cylindrical inner wall (32) which is formed into a front wall (20) of the casing (4) (FIGS. 5 to 11). In this embodiment, the cylindrical inner wall (32) defines the guide which rotatably supports the cartridge (7).

In another embodiment, the cylindrical inner wall (32) also has a channel which advances in a horizontal direction along a length direction of the ice tray (5) (FIGS. 5 to 11). The cartridge (7) has a third engagement portion for slidably engaging with the channel.

In another embodiment, the channel includes: a straight shaped first channel (33) and a helical shaped second channel (34) (FIGS. 9 and 10). The straight shaped first channel (33) is formed in a front end of the cylindrical inner wall (32) (FIGS. 9 to 10). The helical shaped second channel (34) is formed in a rear end of the cylindrical inner wall (32) (FIGS. 9 to 10). The first channel (33) joins the second channel (34) (FIG. 10). Thereby, the cartridge (7) can be smoothly mounted to the port (9). In this embodiment, the third engagement portion is configured by a pin (35) which is provided on the cylindrical outer wall (26) of the cartridge (7) (FIGS. 5 to 11). The pin (35) projects in a radial direction and slidably moves along the first channel (33) and second channel (34) as the cartridge (7) is inserted into the port (9) (FIGS. 5 to 11).

In another embodiment, the opening (8) of the cartridge (7) has a C-shaped cross section within a plane which is normal to a rotational axis of the cartridge (7) (FIG. 8). Thereby, a vacuum effect is prevented so that water can freely flow to an outside of the cartridge (7).

In another embodiment, the cartridge (7) has one or more than one marking (not shown) One of the markings indicates a level of water to be filled into the cartridge (7). Another marking shows the upper/lower level of the opening (8).

The refrigerator (2) of the present invention includes the ice making apparatus (1) as described in any of the above described embodiments (FIGS. 1 and 2).

By the cartridge (7) of the ice making apparatus (1) of the present invention, the ice tray (5) can be easily and reliably filled with a correct amount of fresh water. The ice making apparatus (1) of the present invention can be utilized as a free-standing or a ceiling-mount apparatus. The ice making apparatus (1) of the present invention, can be easily taken out of the refrigerator (2) for cleaning and/or maintenance. Thus, the ice making apparatus (1) of the present invention has improved usability.

The invention claimed is:

1. An ice making apparatus suitable for use in a refrigerator comprising a freezer compartment, the ice making apparatus comprising a casing which includes an ice tray for forming ice, wherein the ice tray has one or more than one pocket for filling with water, the ice making apparatus being characterized by further comprising:

a portable refillable cartridge which has an opening for dispensing water into the ice tray, a port for releasably mounting the cartridge, wherein the port is arranged above the ice tray, and wherein the port has a guide for rotatably supporting the cartridge between a released position where the opening of the cartridge is located at an upper level and a mounted position where the opening of the cartridge is located at a lower level, a first engagement portion which is mountable onto a ceiling of the freezer compartment, and a second engagement portion for slidably mounting an upper wall of the casing to the first engagement portion, wherein the second engagement portion is configured by a rectangular shaped first slot which is formed into the upper wall of the casing, and wherein the first engagement portion is configured by a support member which comprises a rectangular shaped support rail for slidably engaging an edge of the first slot, and one or more than one arresting claw for releasably engaging a rear wall of the casing.

2. The ice making apparatus according to claim 1, characterized in that the ice tray is rotatably arranged between a first position where the one or more than one pocket faces upwards and a second position where the one or more than one pocket faces downwards, wherein the ice tray is resiliently biased towards the first position by means of a resilient member and wherein the ice tray has a first knob for enabling manual rotation thereof.

3. The ice making apparatus according to claim 2, characterized by further comprising:

a cover which configures a front wall of the casing, a housing for accommodating the ice tray, wherein the housing is detachably mounted into the casing, wherein the resilient member is interposed between a rear end of the ice tray and a rear end of the housing, wherein the first knob is detachably fixed to a front end of the ice tray, and rotatably arranged in a first bearing which is formed into the cover, and wherein the rear end of the ice tray has a pivot which is supported by a second bearing which is formed in the rear end of the housing.

4. The ice making apparatus according to claim 3, characterized in that an inner side of the cover has one or more than one arresting claw for releasably engaging with a front end of the housing and the rear wall of the casing has one or more than one arresting claw for releasably engaging with the rear end of the housing.

5. The ice making apparatus according to claim 1, characterized by further comprising an ice drawer for storing the ice which is removed from the ice tray, wherein the ice drawer is slidably arranged into a bottom of the casing and below the ice tray.

6. The ice making apparatus according to claim 1, characterized in that the cartridge includes a cylindrical outer wall, a first end wall and a second end wall, wherein the first end wall and the second end wall oppose each other a second knob for manually rotating of the cartridge, wherein the second knob is detachably mountable to the first end wall and a lid for refilling a space enclosed by the cylindrical outer wall, the first end wall and the second end wall, wherein the second end wall is configured by the lid, wherein said opening is formed on the lid, at a position which is offset by a predetermined distance from an axis of rotation of the cylindrical outer wall.

7. The ice making apparatus according to claim 6, characterized in that the lid has a first threaded portion and the cylindrical outer wall has a second threaded portion, wherein the first threaded portion and the second threaded portion match each other.

8. The ice making apparatus according to claim 1, characterized in that the port is configured by a horizontal second slot for inserting the cartridge into the casing, wherein the second slot has a cylindrical inner wall which is formed into a front wall of the casing, and wherein the cylindrical inner wall defines the guide.

9. The ice making apparatus according to claim 8, characterized in that the cylindrical inner wall has a channel which advances in a horizontal direction along a length direction of the ice tray and the cartridge has a third engagement portion for slidably engaging the channel.

10. The ice making apparatus according to claim 9, characterized in that the channel includes:

a straight shaped first channel which is formed in a front end of the cylindrical inner wall; and a helical shaped second channel which is formed in a rear end of the cylindrical inner wall, wherein the first channel joins the second channel and the third engagement portion is configured by a pin which is provided on a cylindrical outer wall of the cartridge, wherein the pin projects in a radial direction and slidably moves along the first channel and second channel upon insertion of the cartridge into the port.

11. The ice making apparatus according to claim 1, characterized in that the opening of the cartridge has a C-shaped cross section within a plane which is normal to a rotational axis of the cartridge.

12. The ice making apparatus according to claim 1, characterized in that the cartridge has one or more than one marking which respectively indicates a level of water to be filled into the cartridges and/or the upper/lower level of the opening.

13. A refrigerator comprising the ice making apparatus according to claim 1.

14. The ice making apparatus according to claim 1, characterized in that the ice tray is rotatably arranged between a first position where the one or more than one pocket faces upwards and a second position where the one or more than one pocket faces downwards, wherein the ice tray is resiliently biased towards the first position by means of a resilient member and wherein the ice tray has a first knob for enabling manual rotation thereof.

15. The ice making apparatus according to claim 1, wherein the opening dispenses water when the opening is located at the lower level, and wherein the opening does not dispense water when the opening is located at the upper level.

* * * * *